US010836967B2

(12) United States Patent
Al-Wohaibi et al.

(10) Patent No.: US 10,836,967 B2
(45) Date of Patent: Nov. 17, 2020

(54) CONVERTING CARBON-RICH HYDROCARBONS TO CARBON-POOR HYDROCARBONS

(71) Applicant: Saudi Arabian Oil Company, Dhahran (SA)

(72) Inventors: Mohammed A. Al-Wohaibi, Khobar (SA); Vinod Ramaseshan, Ras Tanura (SA); Marcus J. Killingworth, Dhahran (SA); Hisham T. Al-Bassam, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 222 days.

(21) Appl. No.: 16/009,404

(22) Filed: Jun. 15, 2018

(65) Prior Publication Data

US 2018/0362865 A1 Dec. 20, 2018

Related U.S. Application Data

(60) Provisional application No. 62/520,349, filed on Jun. 15, 2017.

(51) Int. Cl.
*C10G 67/04* (2006.01)

(52) U.S. Cl.
CPC ... *C10G 67/049* (2013.01); *C10G 2300/4081* (2013.01)

(58) Field of Classification Search
CPC ..... C10G 67/049; C10G 2300/4081
See application file for complete search history.

(56) References Cited

U.S. PATENT DOCUMENTS 2,950,241 A 8/1960 Craft et al.
3,147,210 A 9/1964 Hass et al.
(Continued)

FOREIGN PATENT DOCUMENTS

CN 102311798 1/2012
CN 102311799 1/2012
(Continued)

OTHER PUBLICATIONS

International Search Report and Written Opinion issued in International Application No. PCT/US2018/037694 dated Sep. 26, 2018, 18 pages.

(Continued)

*Primary Examiner* — Randy Boyer
*Assistant Examiner* — Juan C Valencia
(74) *Attorney, Agent, or Firm* — Fish & Richardson P.C.

(57) ABSTRACT

A system for co-processing crude oil with residuum includes an ebullated bed hydrocracking unit; an atmospheric distillation column fluidly coupled to the ebullated bed hydrocracking unit; a vacuum distillation column fluidly coupled to the atmospheric distillation column and the ebullated bed hydrocracking unit; and a deasphalting unit fluidly coupled to the vacuum distillation column and the ebullated bed hydrocracking unit; and a control system communicably coupled to the ebullated bed hydrocracking unit, the atmospheric distillation column, the vacuum distillation column, and the deasphalting unit. The control system is configured to perform operations including operating the deasphalting unit to produce a first cut that includes deasphalting oil, a second cut that includes resin oil, and a third cut that includes asphaltene.

30 Claims, 4 Drawing Sheets

(56) References Cited

U.S. PATENT DOCUMENTS

| | | | | |
|---|---|---|---|---|
| 3,256,178 | A | 6/1966 | Hass et al. | |
| 4,082,647 | A | 4/1978 | Hutchings et al. | |
| 4,211,635 | A | 7/1980 | Chen | |
| 4,239,616 | A | 12/1980 | Gearhart | |
| 4,317,711 | A | 3/1982 | Yan | |
| 5,013,247 | A | 5/1991 | Watson | |
| 5,322,829 | A | 6/1994 | Artes et al. | |
| 5,466,362 | A * | 11/1995 | Steinberg | B01J 8/0035 208/152 |
| 5,814,286 | A * | 9/1998 | Hood | B01D 17/0208 196/14.52 |
| 5,904,835 | A | 5/1999 | Thakkar | |
| 6,179,995 | B1 | 1/2001 | Cash et al. | |
| 6,270,654 | B1 | 8/2001 | Colyar et al. | |
| 6,299,759 | B1 | 10/2001 | Bradway | |
| 6,312,586 | B1 | 11/2001 | Kalnes et al. | |
| 6,436,279 | B1 | 8/2002 | Colyar | |
| 6,547,956 | B1 | 4/2003 | Mukherjee et al. | |
| 7,238,275 | B2 | 7/2007 | Stupin et al. | |
| 7,279,090 | B2 | 10/2007 | Colyar et al. | |
| 7,547,386 | B1 | 6/2009 | Thakkar et al. | |
| 7,622,034 | B1 | 11/2009 | Thakkar et al. | |
| 7,686,941 | B2 | 3/2010 | Brierley et al. | |
| 7,708,877 | B2 | 5/2010 | Farshid et al. | |
| 7,938,952 | B2 | 5/2011 | Colyar et al. | |
| 8,110,090 | B2 | 2/2012 | Zimmerman et al. | |
| 8,133,446 | B2 | 3/2012 | McGehee et al. | |
| 8,193,401 | B2 | 6/2012 | McGehee et al. | |
| 9,074,143 | B2 | 7/2015 | McGehee et al. | |
| 9,440,894 | B2 | 9/2016 | Baldassari et al. | |
| 9,687,804 | B2 | 6/2017 | Mukherjee et al. | |
| 2006/0118463 | A1 | 6/2006 | Colyar et al. | |
| 2008/0149534 | A1 | 6/2008 | Gauthier et al. | |
| 2009/0288984 | A1 | 11/2009 | Colyar | |
| 2009/0308788 | A1 | 12/2009 | Lenglet | |
| 2010/0122934 | A1 | 5/2010 | Haizmann et al. | |
| 2011/0139676 | A1 | 6/2011 | McGehee et al. | |
| 2011/0139681 | A1 | 6/2011 | McGehee et al. | |
| 2011/0142729 | A1 | 6/2011 | McGehee et al. | |
| 2012/0061293 | A1 | 3/2012 | Sanchez et al. | |
| 2012/0234726 | A1 | 9/2012 | Morel | |
| 2014/0138287 | A1 | 5/2014 | De Klerk et al. | |
| 2014/0221709 | A1 | 8/2014 | Baldassari et al. | |
| 2014/0238903 | A1 | 8/2014 | Irudayaraj et al. | |
| 2015/0038599 | A1 | 2/2015 | Kresnyak | |
| 2015/0238882 | A1 * | 8/2015 | Ladkat | B01D 3/009 422/187 |
| 2015/0329790 | A1 | 11/2015 | Yang | |
| 2016/0068767 | A1 | 3/2016 | Harvey et al. | |
| 2017/0369796 | A1 * | 12/2017 | Le Coz | C10G 65/12 |

FOREIGN PATENT DOCUMENTS

| | | |
|---|---|---|
| CN | 102652169 | 8/2012 |
| CN | 103102944 | 5/2013 |
| CN | 103102945 | 5/2013 |
| CN | 103102980 | 5/2013 |
| CN | 103102982 | 5/2013 |
| JP | 2014524967 | 9/2014 |
| OA | 12971 | 10/2006 |
| WO | 2009003633 | 1/2009 |
| WO | 2009062088 | 5/2009 |
| WO | 2010004126 | 1/2010 |
| WO | 2010004127 | 1/2010 |
| WO | 2010004128 | 1/2010 |
| WO | 2010053865 | 5/2010 |
| WO | 2010056436 | 5/2010 |
| WO | 2011071705 | 6/2011 |
| WO | 2015082313 | 6/2015 |

OTHER PUBLICATIONS

Spieler et al., "AM-06-64: Upgrading Residuum to Finished Products in Integrated Hydroprocessing Platforms: Solutions and Challenges," NPRA (National Petrochemical and Refiners Association), Annual Meeting, Mar. 19-21, 2006, 19 pages.

GCC Examination Report in GCC Appln. No. GC 2018-35493, dated Dec. 25, 2019, 3 pages.

International Search Report and Written Opinion issued in International Application No. PCT/US2018/048426 dated Oct. 30, 2018, 13 pages.

GCC Examination Report in GCC Appln. No. GC 2018-35493, dated May 9, 2020, 3 pages.

* cited by examiner

CONVERTING CARBON-RICH HYDROCARBONS TO CARBON-POOR HYDROCARBONS

CROSS-REFERENCE TO RELATED APPLICATION

This application claims priority under 35 U.S.C. § 119 to U.S. Provisional Patent Application Ser. No. 62/520,349, filed on Jun. 15, 2017, and entitled "CONVERTING CARBON-RICH HYDROCARBONS TO CARBON-POOR HYDROCARBONS," the entire contents of which are incorporated by reference herein.

TECHNICAL FIELD

This disclosure relates to systems and processes for converting carbon-rich hydrocarbons to carbon-poor hydrocarbons.

BACKGROUND

Recent trends in refining encourage refiners to operate on heavier crudes and maximize white oil products. Future sulfur level reduction in high sulfur fuel oil (HSFO) may also encourage refiners to upgrade the bottom of the barrel. In many refineries, there are limitations imposed in existing crude distillation columns when processing heavy crudes (or different crudes).

SUMMARY

This disclosure relates to the addition of virgin crude to a common fractionation section along with synthetic crude from a reaction section or residue hydrocracking unit and a resin cut within an ebullated bed reactor effluent stream to promote higher per pass conversion and reduced asphaltene precipitation. The use of crude oil allows only a slip stream to be solvent deasphalted, thus reducing overall capital expenditure and operational expenditure in a facility. The common fractionation section, as shown, may be common to both virgin crude processing and SYNC produced from the ebullated hydrocracking unit.

The integration of an ebullated bed hydroprocessing fractionation section and a (virgin) crude atmospheric and vacuum distillation unit is described in which both ebullated bed hydroprocessing reactor effluent hydrocarbon (SYNC) and desalted virgin crude are fractionated in a common atmospheric and vacuum distillation unit. The combined vacuum column bottom (from both crude sources) is recycled back and fed to the ebullated bed unit reaction section after removal of a drag stream of approximately 10-20% to be upgraded in a three-product cut solvent deasphalting unit (SDU). All other fractionated products (stabilized hydrocarbons boiling less than a nominal true boiling point (TBP) of 565° Celsius (C)) are processed in downstream refining process units to make on-spec products with a portion of the deasphalted oil (DAO) from the SDU recycled back and fed to the ebullated bed reaction section.

Crude oil being sent to the fractionation section in conjunction with the reactor effluent is provided as a solvent to keep asphaltenes in solution at much higher rates than typically achieved, thereby enabling higher reactor conversion. In one example, conversion is in a range of 85-90 percent by weight (wt %). The combination of virgin crude oil processing or part(s) of virgin crude of at least 25 wt % of the ebullated bed hydroprocessing residue fresh feed promotes design and stable operation of a common fractionation section. The amount of virgin crude processed may be increased when one of the reaction loops (for example, most residue hydrocracking units at capacity rates in excess of 45 thousands of barrels of oil per day (MBD) have multiple reactor trains) is shut down to maintain the fractionation section greater than a turndown ability without extra measures and deliver feed stock to downstream units, thereby keeping utilization up. The virgin crude type and quantity to combine with the reactor effluent (SYNC) for processing in the fractionation section of the ebullated bed hydroprocessing unit is selected and optimized taking the type of vacuum residue fresh feed upgraded by the ebullated bed hydroprocessing unit, the reaction conversion level, the intended products of the refinery hosting the ebullated bed hydroprocessing unit, and the refinery configuration into consideration.

The described implementations can yield a higher overall conversion of residuum oil, better fractionation operations, superior capital and operating expenditures in the fractionation zone, and better column design (turndown ability), thus increasing the mechanical availability of the system.

In an example general implementation, a system for co-processing crude oil with residuum includes an ebullated bed hydrocracking unit; an atmospheric distillation column fluidly coupled to the ebullated bed hydrocracking unit; a vacuum distillation column fluidly coupled to the atmospheric distillation column and the ebullated bed hydrocracking unit; and a deasphalting unit fluidly coupled to the vacuum distillation column and the ebullated bed hydrocracking unit; and a control system communicably coupled to the ebullated bed hydrocracking unit, the atmospheric distillation column, the vacuum distillation column, and the deasphalting unit. The control system is configured to perform operations including operating the deasphalting unit to produce a first cut that includes deasphalting oil, a second cut that includes resin oil, and a third cut that includes asphaltene.

In an aspect combinable with the general implementation further includes a stripping column fluidly coupled between the ebullated bed hydrocracking unit and the atmospheric distillation column.

In another aspect combinable with any one of the previous aspects, the control system is configured to perform operations including circulating effluent from the ebullated bed hydrocracking unit to the stripping column to yield a stripping column bottom stream; circulating the stripping column bottom stream and desalted virgin crude to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the deasphalting unit to yield the first cut, the second cut, and the third cut; combining the first cut and a second portion of the vacuum distillation column bottom stream to yield a combined recycle stream; circulating the combined recycle stream to the ebullated bed hydrocracking unit; and circulating the second cut to the ebullated bed hydrocracking unit.

Another aspect combinable with any one of the previous aspects further includes a stripping column fluidly coupled between the ebullated bed hydrocracking unit and the atmospheric distillation column.

In another aspect combinable with any one of the previous aspects, the control system is configured to perform operations including circulating desalted virgin crude and effluent from the ebullated bed hydrocracking unit to the stripping column to yield a stripping column bottom stream; circulating the stripping column bottom stream to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the deasphalting unit to yield the first cut, the second cut, and the third cut; combining the first cut and a second portion of the vacuum distillation column bottom stream to yield a combined recycle stream; circulating the combined recycle stream to the ebullated bed hydrocracking unit; and circulating the second cut to the ebullated bed hydrocracking unit.

Another aspect combinable with any one of the previous aspects further includes a pre-flash column operating at atmospheric column pressure fluidly coupled between the ebullated bed hydrocracking unit and the atmospheric distillation column.

In another aspect combinable with any one of the previous aspects, the control system is configured to perform operations including circulating desalted virgin crude and effluent from the ebullated bed hydrocracking unit to the pre-flash column to yield a pre-flash column bottom stream; combining a partially condensed overhead stream from the pre-flash column with a partially condensed overhead stream from the atmospheric distillation column; circulating the pre-flash column bottom stream to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the deasphalting unit to yield the first cut, the second cut, and the third cut; combining the first cut and a second portion of the vacuum distillation column bottom stream to yield a combined recycle stream; circulating the combined recycle stream to the ebullated bed hydrocracking unit; and circulating the second cut to the ebullated bed hydrocracking unit.

In another aspect combinable with any one of the previous aspects, the control system is configured to perform operations including circulating effluent from the ebullated bed hydrocracking unit and desalted virgin crude to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the deasphalting unit to yield the first cut, the second cut, and the third cut; combining the first cut and a second portion of the vacuum distillation column bottom stream to yield a combined recycle stream; circulating the combined recycle stream to the ebullated bed hydrocracking unit; and circulating the second cut to the ebullated bed hydrocracking unit.

In another aspect combinable with any one of the previous aspects, at least 85 wt % of a vacuum residue fresh feed to the ebullated bed hydrocracking unit is converted into a lighter white oil fraction.

In another aspect combinable with any one of the previous aspects, the control system is configured to perform operations including heating a desalted virgin crude before providing the desalted virgin crude to the atmospheric distillation column; and circulating the desalted virgin crude to the atmospheric distillation column in a range of 1% to at least 80% of a volumetric feed rate of the vacuum residue fresh feed rate.

In another aspect combinable with any one of the previous aspects, the first portion of the vacuum distillation column bottom stream includes 40 vol % to 60 vol % of the vacuum distillation column bottom stream.

In another aspect combinable with any one of the previous aspects, the first cut further includes 40 wt % to 60 wt % of the first portion of a vacuum distillation column bottom stream, and the second cut further includes 20 wt % to 40 wt % of the first portion of a vacuum distillation column bottom stream.

In another aspect combinable with any one of the previous aspects, the control system is configured to perform operations including circulating the second cut to the ebullated bed hydrocracking unit as a flux oil for effluent from the ebullated bed hydrocracking unit.

In another aspect combinable with any one of the previous aspects, the desalted virgin crude includes a diluent in the atmospheric distillation column.

In another aspect combinable with any one of the previous aspects, the control system is configured to perform operations including recycling naphtha as a stripping media to remove hydrogen sulfide.

In another general implementation, a method for co-processing crude oil with residuum includes fluidly coupling an ebullated bed hydrocracking unit with an atmospheric distillation column; fluidly coupling a vacuum distillation column to the atmospheric distillation column and the ebullated bed hydrocracking unit; fluidly coupling a deasphalting unit to the vacuum distillation column and the ebullated bed hydrocracking unit; and operating the deasphalting unit to produce a first cut that includes deasphalting oil, a second cut that includes resin oil, and a third cut that includes asphaltene.

An aspect combinable with the general implementation further includes fluidly coupling a stripping column between the ebullated bed hydrocracking unit and the atmospheric distillation column.

Another aspect combinable with any one of the previous aspects further includes circulating effluent from the ebullated bed hydrocracking unit to the stripping column to yield a stripping column bottom stream; circulating the stripping column bottom stream and desalted virgin crude to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the three-cut solvent deasphalting unit to yield a first cut, a second cut, and a third cut; combining the first cut and a second portion of the vacuum distillation column bottom stream to yield a combined recycle stream, and circulating the combined recycle stream to the ebullated bed hydrocracking unit; and circulating the second cut to the ebullated bed hydrocracking unit.

Another aspect combinable with any one of the previous aspects further includes fluidly coupling a stripping column between the ebullated bed hydrocracking unit and the atmospheric distillation column.

Another aspect combinable with any one of the previous aspects further includes circulating desalted virgin crude and effluent from the ebullated bed hydrocracking unit to the stripping column to yield a stripping column bottom stream; circulating the stripping column bottom stream to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the three-cut solvent deasphalting unit to yield a first cut, a second cut, and a third cut; combining the first cut and a second portion of the vacuum distillation column bottom stream to yield a combined recycle stream, and circulating the combined recycle stream to the ebullated bed hydrocracking unit; and circulating the second cut to the ebullated bed hydrocracking unit.

Another aspect combinable with any one of the previous aspects further includes fluidly coupling a pre-flash operating at atmospheric column pressure between the ebullated bed hydrocracking unit and the atmospheric distillation column.

Another aspect combinable with any one of the previous aspects further includes circulating desalted virgin crude and effluent from the ebullated bed hydrocracking unit to the pre-flash column to yield a pre-flash column bottom stream; combining a partially condensed overhead stream from the pre-flash column with a partially condensed overhead stream from the atmospheric distillation column; circulating the pre-flash column bottom stream to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the three-cut solvent deasphalting unit to yield a first cut, a second cut, and a third cut; combining the first cut and a second portion of the vacuum distillation column bottom stream to yield a combined recycle stream, and circulating the combined recycle stream to the ebullated bed hydrocracking unit; and circulating the second cut to the ebullated bed hydrocracking unit.

Another aspect combinable with any one of the previous aspects further includes circulating effluent from the ebullated bed hydrocracking unit and desalted virgin crude to the atmospheric distillation column to yield an atmospheric distillation column bottom stream; circulating the atmospheric distillation column bottom stream to the vacuum distillation column to yield a vacuum distillation column bottom stream; circulating a first portion of the vacuum distillation column bottom stream to the three-cut solvent deasphalting unit to yield a first cut, a second cut, and a third cut; combining the first cut and a second portion of the vacuum distillation column bottom stream to yield a combined recycle stream, and circulating the combined recycle stream to the ebullated bed hydrocracking unit; and circulating the second cut to the ebullated bed hydrocracking unit.

In another aspect combinable with any one of the previous aspects, at least 85 wt % of a vacuum residue fresh feed is converted into a lighter white oil fraction in the ebullated bed hydrocracking unit.

Another aspect combinable with any one of the previous aspects further includes heating desalted virgin crude before circulating the desalted virgin crude to the atmospheric distillation column; and circulating the desalted virgin crude to the atmospheric distillation column in a range of 1% to at least 80% of a volumetric feed rate of the vacuum residue fresh feed rate.

In another aspect combinable with any one of the previous aspects, the first portion of the vacuum distillation column bottom stream includes 40 vol % to 60 vol % of the vacuum distillation column bottom stream.

In another aspect combinable with any one of the previous aspects, the first cut further includes 40 wt % to 60 wt % of the first portion of a vacuum distillation column bottom stream, and the second cut further includes 20 wt % to 40 wt % of the first portion of the vacuum distillation column bottom stream.

Another aspect combinable with any one of the previous aspects further includes circulating the second cut to the ebullated bed hydrocracking unit as a flux oil for effluent from the ebullated bed hydrocracking unit.

In another aspect combinable with any one of the previous aspects, the desalted virgin crude includes a diluent in the atmospheric distillation column.

Another aspect combinable with any one of the previous aspects further includes recycling naphtha as a stripping media to remove hydrogen sulfide.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1:
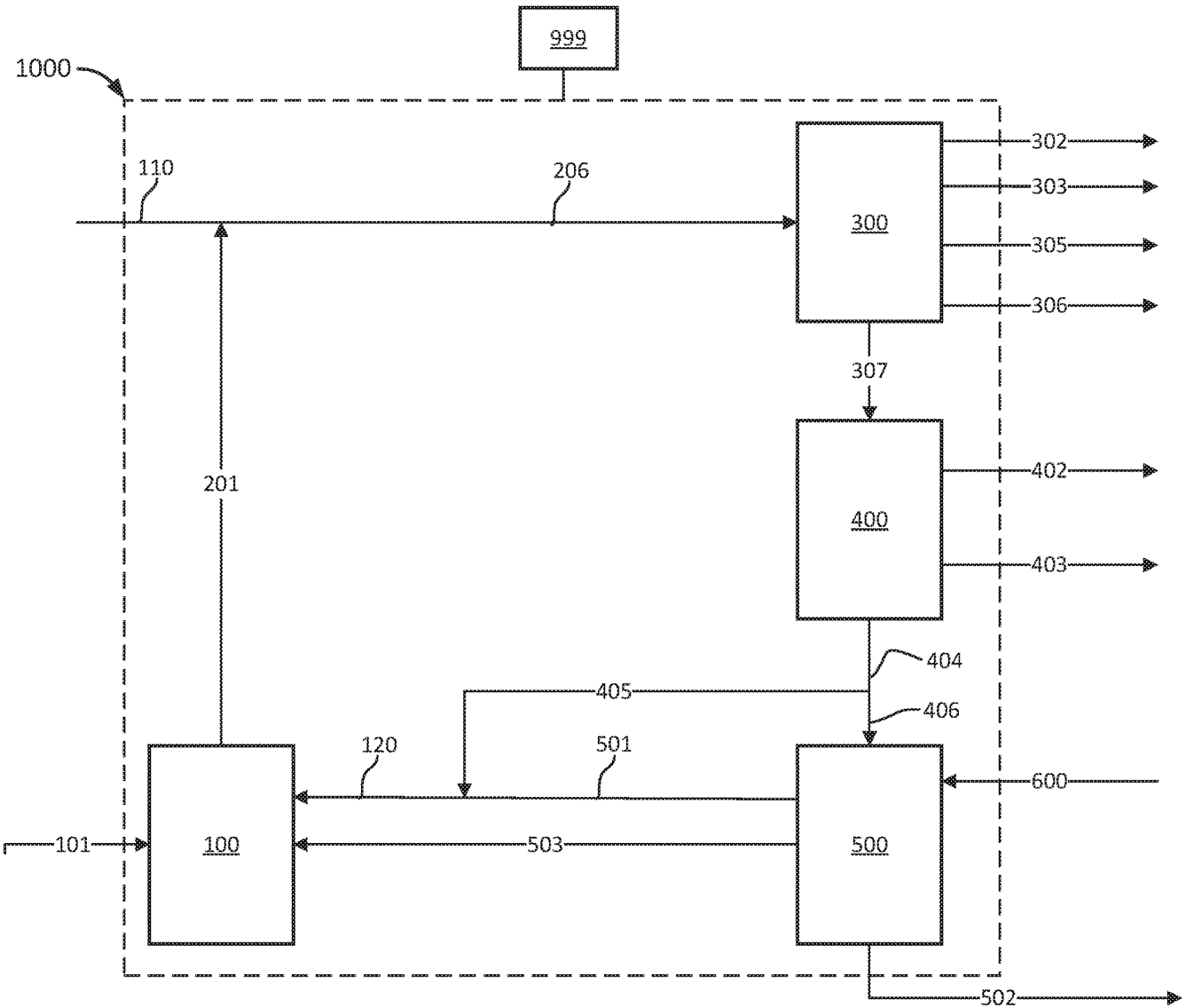
FIG. 1 depicts an example implementation of a residue hydrocracking unit, integrated fractionation, and solvent deasphalting unit system and flow scheme.

A process for improving the conversion of main refinery crude charge vacuum column bottom (vacuum residue fresh feed) into lighter white oil fractions is described. The process scheme dovetails an ebullated bed hydrocracking unit or residue hydrocracking unit (RHCU) synthetic crude (SYNC) effluent with desalted virgin crude oil and fractionates the same in a common fractionation section. The common fractionation section after the RHCU vacuum column bottoms is divided into two parts with the first part directly recycled to feed the RHCU reactor section along with vacuum residue fresh feed. The second part (the major part) is deasphalted in a three-cut solvent deasphalting unit (SDU). The deasphalting oil (DAO) (SDU cut 1) and resin oil (SDU cut 2) are recycled back to the RHCU reactor section along with vacuum residue fresh feed. The combination of virgin crude oil vacuum residue (as part of the directly recycled vacuum residue), resin oil and DAO promotes a higher conversion across the RHCU, thus enabling higher conversion of vacuum residue fresh feed to white oil products. The reject stream from the SDU (pitch) (SDU cut 3) is routed either as a fuel component, to a bitumen blending plant, or both. The described flow scheme allows conversion of vacuum residue fresh feed (565° C.+feed) on the order of 85-95% (565° C.−).

Fresh vacuum residue is processed along with directly recycled vacuum residue from the RHCU combined fractionation section and DAO in a RHCU reaction section. The vacuum residue is mixed with hydrogen under pressure and heat and reacted over a "base metal" catalyst under ebullated bed conditions. The reactor effluent is then separated in multiple separators or flash drums where a small amount of "resin oil" is injected to suppress asphaltene precipitation in the reaction loop and down stream equipment. The excess flashed recycle gas is then amine treated and recycled back to the reactor section through a recycle gas compressor. Make up gas (hydrogen) is supplied by the make up gas compressor. Flash gases from the flash drums that are sour in nature are routed out of the unit for further processing. The effluent from the separation/flash drums are then stripped in a stripping column and mixed with preheated desalted virgin crude (usually about and at least the range of 1-25% and more towards 25% of the RHCU volumetric vacuum residue fresh feed rate) and then fractionated in a common and integrated atmospheric and vacuum distillation column. The gases along with distillates from these fractionation towers are then routed to other processing units to produce finished transportation and specialty products. The heavy oil (essentially a mixture of unconverted oil from the RHCU and the excess and unreacted vacuum residue component from the additional desalted virgin crude processed) are the partially recycled back to the RHCU feed section. A slip or drag stream (between 40-60 vol % of the vacuum fractionation tower bottom) is routed to SDU. This oil is then deasphalted using a conventional SDU to make three cuts. The light cut DAO (about 40-60 wt % of the feed to the SDU) is recycled back to the RHCU reactors to further reduce the total reactors feed asphaltenes level allowing additional per-pass conversion. The pitch (heavy asphaltene) is either rejected as a fuel or the asphalt product. An intermediate cut, known as resin Oil (which is aromatic and polar and about 20-40 wt % of the SDU feed) is recycled back as a flux oil to the separation/flash vessels as a solvent to reduce asphaltene precipitation in the RHCU.

In some aspects, "stream" or "main stream" refers to various hydrocarbon molecules, such as straight chain, branched or cyclical alkanes, alkenes, alkadienes, alkynes, aromatics, and other substances such as gases and impurities. A stream may include aromatic and nonaromatic compounds.

In some aspects, "zone" refers to an area including one or more equipment items and/or one or more sub-zones. Equipment items include one or more reactors or reactor vessels, heaters, exchangers, pipes, pumps, compressors and controllers. Additionally, an equipment item, such as a vessel, may further include one or more zones.

In some aspects, "rich" refers to an amount of at least generally about 50% and preferably about 70%, by mole, mass, or volume of a compound or class of compounds in a stream.

In some aspects, "substantially" refers to an amount of at least generally about 80%, preferably about 90%, and optimally about 99%, by mole or mass or volume, of a compound or class of compounds in a stream.

In some aspects, "slip stream" refers to an amount of at least generally about 5%, preferably about 20%, and optimally about 25%, by volume of the main stream.

In some aspects, "synthetic crude" (SYNC) refers to an ebullated bed reactor (residue hydrocracking) effluent. This is unstablized full boiling point range effluent.

In some aspects, "asphaltenes" refers to a heavy polar fraction and is the residue that remains after the resins and oils have been separated from the feed residue fed to a SDU. Asphaltenes from vacuum residue are generally characterized as follows: a Conradson or Ramsbottom carbon residue of 15 to 90 wt % and a hydrogen to carbon (H/C) atomic ratio of 0.5 to 1.5. Asphaltenes may contain from 50 ppm to greater than 5000 ppm vanadium and from 20 ppm to greater than 2000 ppm nickel. The sulfur concentration of asphaltenes may be from 110% to 350% greater than the concentration of sulfur in the residue oil feed oil to the deasphalter. The nitrogen concentration of asphaltenes may be from 100% to 350% greater than the concentration of nitrogen in the residue oil feed oil to the deasphalting unit.

In some aspects, "residuum" refers to residue oil, which is essentially made of oil from the vacuum column bottom, thermally cracked residue, or slurry oil from a fluid catalytic cracking unit.

In some aspects, "resin oil" refers to an aromatic polar fraction which is an intermediate between the deasphalted oil and asphaltene (pitch) separated from the feed residue to a deasphalting unit. Resins are denser or heavier than deasphalted oil, but lighter than the aforementioned asphaltenes. The resin product usually includes more aromatic hydrocarbons with highly aliphatic substituted side chains, and may also include metals, such as nickel and vanadium. Generally, the resins include the material from which asphaltenes and DAO have been removed.

In some aspects, "deasphalted oil" or DAO refers to oil that is generally the least dense products produced in a deasphalting unit and typically include saturated aliphatic, alicyclic, and some aromatic hydrocarbons. Deasphalted oil generally includes less than 30% aromatic carbon and relatively low levels of heteroatoms except sulphur. Deasphalted oil from vacuum residue can be generally characterized as follows: a Conradson or Ramsbottom carbon residue of 1 to less than 12 wt % and a hydrogen to carbon (H/C) ratio of 1% to 2%. Deasphalted oil may contain 100 ppm or less, preferably less than 5 ppm, and most preferably less than 2 ppm, of vanadium and 100 ppm or less, preferably less than 5 ppm, and most preferably less than 2 ppm of nickel. The sulfur and nitrogen concentrations of deasphalted oil may be 90% or less of the sulfur and nitrogen concentrations of the residue oil feed oil to the deasphalting unit.

In some aspects, "true boiling point" or TBP refers to a standard batch distillation test (in line with ASTM D 2892) for crude oil or its fractions to determine the quantity of the petroleum cuts within the oil in question.

FIG. 1 depicts system 1000 including an RHCU reaction and separation zone 100 (or RHCU unit 100), integrated fractionation (IF) 300/400, and SDU 500 (or SDU section 500). The RHCU reaction and separation zone 100 includes, in some aspects, two parallel reactor/separation trains containing an effective quantity of a suitable catalyst (for example, an amount of catalyst that is based on a particular liquid hourly space velocity (LHSV) that is commensurate with the coversion taking place in the parallel reactor/separation trains). In some aspects, two parallel trains may be utilized in RHCU unit 100 with identical or similar operational conditions based on, for example, feed quantity and quality. The outputs of the parallel trains (for example, combined as a mixed stream 201) include reactor effluent which have been flashed in the separators of the RHCU unit 100 to remove most (but possibly not all) hydrogen, hydrogen sulfide, and ammonia gas ($NH_3$). The reactor effluent (201) is SYNC.

The parallel reactor/separation trains include an inlet for receiving a combined stream that includes a vacuum residue fresh feed stock stream 101 of refinery vacuum column bottoms, a recycle stream 120 from the SDU section 500, and hydrogen make up streams (combined into the stream 101). The hydrocracked effluent or SYNC streams are discharged, after multiple high and low pressure and temperature separation/flashing, to a stripping section as a mixed stream 201. Recycle gas streams within the RHCU section 100 which include or consist essentially of hydrogen are amine treated and then recycled back into the reaction loop. Flash gases from flash drums in the RHCU unit 100, which are rich in hydrogen, can be routed away from unit 100 as sour gas streams (not shown in the figure) for additional treatment and hydrogen recovery.

Also, flux oil streams can be injected at the separator and flash vessels within the RHCU unit 100. The flux oil mixes with the reactant effluent. Details of the process flow scheme, utility streams (including injection water), and items of equipment (heat transfer, mass transfer, and fluid conveying items of equipment within the RHCU unit 100 generally understood in the art are not depicted. The effluents from the parallel trains are combined together to form the stream 201 which is combined with desalted preheated virgin crude oil 110 and routed to IF section unit 300 as stream 206. The integrated fractionation section unit 300 includes a fractionation column heater, atmospheric distillation tower.

Stream 206 is heated through the heater of the IF section unit 300 and routed as to a flash zone of an atmospheric distillation column of the IF section unit 300. The atmospheric distillation column may be a trayed column with multiple side cuts. The overhead vapor stream is partially condensed into a reflux stream and an unstablized whole naphtha stream 303. Multiple side cuts such as stream 305 and 306 are essentially distillate streams and are routed to downstream processing units for further treatment. A column of the IF section unit 300 is a steam stripping column. Heat transfer, mass transfer, and fluid conveying items of equipment generally understood in the art are not depicted in FIG. 1.

The atmospheric column bottom stream 307 is routed to the vacuum column section 400 (of the IF section) and heated in a heater and flashed as a stream in the flash zone of the vacuum distillation column of the section 400. The vacuum distillation column may be a packed tray column with trays essentially in the bottom half of the column lower than the feed flash zone. The vacuum is generated using a steam ejector system and the column operates as a "wet vacuum column." Vacuum distillate streams 402 and 403 are then further processed in downstream process units. The vacuum column bottom (boiling greater than 565° C. TBP) stream 404 may be a mixture of unconverted oil from the RHCU unit 100 and virgin vacuum residue from the virgin crude oil processed in the integrated fractionation section.

A slip stream 406 is routed to an SDU section 500 and the remaining oil 405 is recycled back to the RHCU unit 100. The SDU section 500 includes liquid-liquid extraction using a combination of propane (C3) and butane (C4), or a combination of C4 and pentane (C5) (and more preferably C4/C5) solvent stream 600 and three cuts are separated. After solvent recovery, the light (relatively asphaltene free) DAO cut 501 is withdrawn and mixes with stream 405 to form the combined recycle stream 120. In some aspects, relatively asphaltene free DAO cut 501 contains less than 5% asphaltene.

The heavy cut (after solvent recovery) containing asphaltene is routed as a fuel component or to bitumen manufacture as stream 502. The middle cut resin oil (again after solvent recovery) containing heavier aromatics as stream 503 is routed back as fluxing oil to the RHCU unit 100 separator/flash vessels. A slip stream of the resin oil can also routed directly into the RHCU unit 100 reactors as a feed component. The SDU solvent is mostly recovered; a small amount of topping is required to account for losses.

Thus, as depicted in FIG. 1, desalted crude stream 110 is mixed with stream 201 and is directly routed to the heater of the IF section unit 300. A light end stripping is not considered necessary when the conversion per pass on the RHCU unit 100 is limited and is generally less than 50%. In some aspects, the conversion that can be done in the ebullated hydrocracking unit is limited by the fact that the reactor effluent 201 is more paraffinic than the feed 101 to the unit 100. The feed is essentially vacuum tower bottom, which has paraffin (for example, a small amount), naphthene, aromatics, and asphaltene. The aromatics keep the asphaltene in solution and thus does not precipitate. As the feed goes through the ebullated bed hydrocracking reactor, it is hydrogenated and dearomatization occurs; thus the remaining asphaltene will tend to precipitate out and if that happens there will be fouling and coking in the items of equipment. Thus there is a limit to cracking of the feed in the ebullated bed hydrocracking to about 60-70%. Flux oil may be added, which is essentially aromatics to enhance the solubility and thus try and increase conversion. The illustrated flow schemes accomplish this by using the resin cut, which makes the feed superior by using some DAO along with the vacuum tower bottom, thus increasing the overall conversion. The reject thus becomes the pitch from the SDA. The conversion is measured by taking samples at the reactor effluent (and conducting a TBP test to see how much of the feed is converted to a temperature greater than a 550-565° C. cut point) and also can be found out on gross flow basis by measuring the fresh feed rate and vacuum column bottom rate and recycle oil rate and performing a mass balance.

Figure 2:
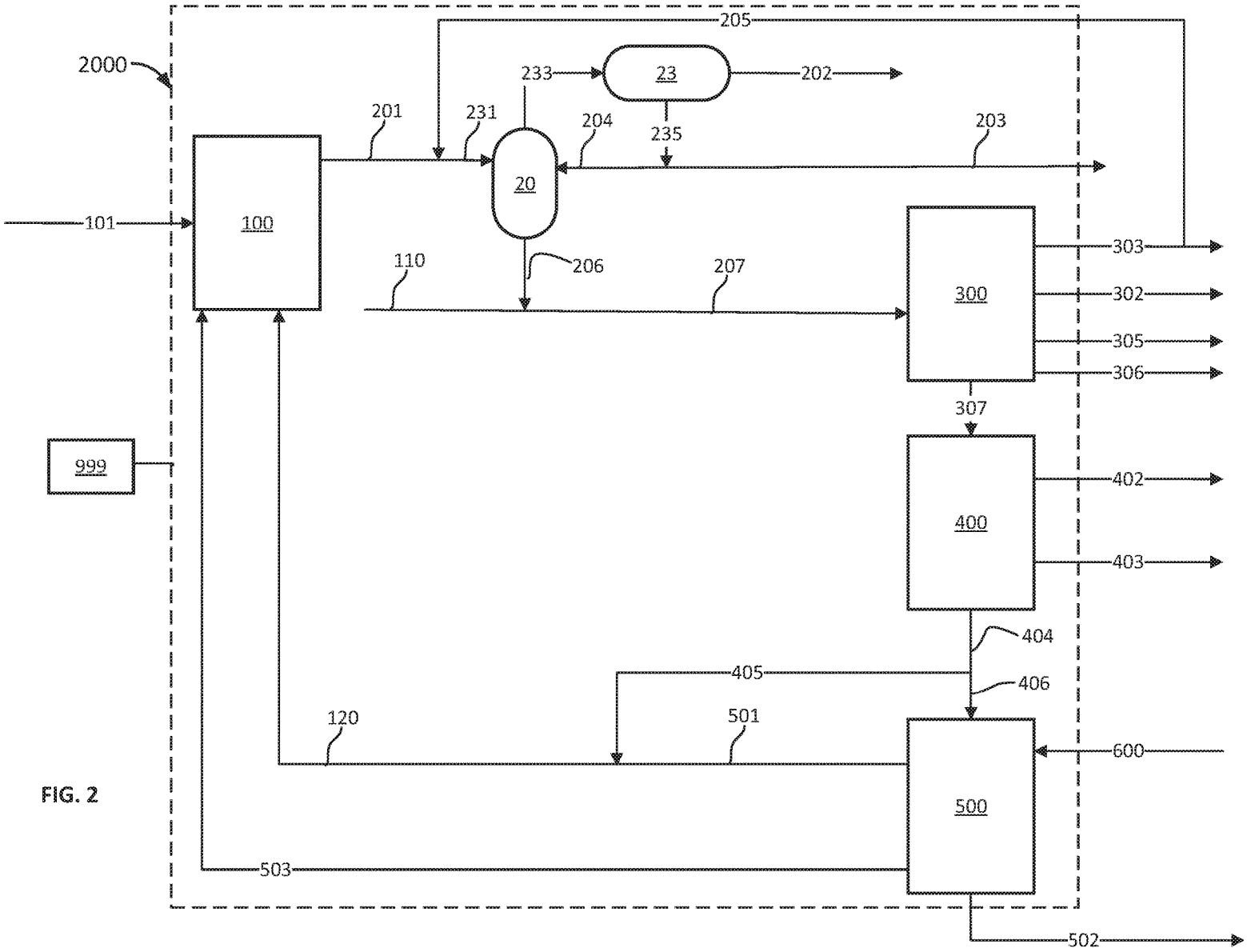
FIG. 2 depicts another example implementation of a residue hydrocracking unit, integrated fractionation, and solvent deasphalting unit system and flow scheme.

FIG. 2 depicts system 2000 including an RHCU reaction and separation zone 100 (or RHCU unit 100), integrated fractionation (IF) units 300 and 400, and SDU 500 (or SDU section 500). The RHCU reaction and separation zone 100 includes, in some aspects, two parallel reactor/separation trains containing an effective quantity of a suitable catalyst (for example, an amount of catalyst that is based on a particular liquid hourly space velocity (LHSV) that is commensurate with the coversion taking place in the parallel reactor/separation trains). In some aspects, two parallel trains may be utilized in RHCU unit 100 with identical or similar operational conditions based on, for example, feed quantity and quality. The outputs of the parallel trains (for example, combined as a mixed stream 201) include reactor effluent which have been flashed in the separators of the RHCU unit 100 to remove most (but possibly not all) hydrogen, hydrogen sulfide, and ammonia gas ($NH_3$). The reactor effluent (201) is SYNC.

The parallel reactor/separation trains include an inlet for receiving a combined stream that includes a vacuum residue fresh feed stock stream 101 of refinery vacuum column bottoms, a recycle stream 120 from the SDU section 500, and hydrogen make up streams (combined into the stream 101). The hydrocracked effluent or SYNC streams are discharged, after multiple high and low pressure and temperature separation/flashing, to the stripping section 20 as a mixed stream 201. Recycle gas streams within the RHCU section 100 which include or consist essentially of hydrogen are amine treated and then recycled back into the reaction loop. Flash gases from flash drums in the RHCU unit 100, which are rich in hydrogen, can be routed away from unit 100 as sour gas streams (not shown in the figure) for additional treatment and hydrogen recovery.

Also, flux oil streams can be injected at the separator and flash vessels within the RHCU unit 100. The flux oil mixes with the reactant effluent. Details of the process flow scheme, utility streams (including injection water), and items of equipment (heat transfer, mass transfer, and fluid conveying items of equipment within the RHCU unit 100 generally understood in the art are not depicted. The effluents from the parallel trains are combined together to form the stream 201 which is routed to a stripping column 20 in a stripping zone.

As depicted, process flow lines in the figures can be referred to as streams, feeds, products or effluents. The stripping column 20 is a steam stripped column in which the vapor stream 233 is condensed in condenser 23, output as stream 235, and partially refluxed as stream 204 back to the column and a stream 203 and uncondensed vapor stream 202 (if any) are routed for further processing. The stripping column 20 may be a trayed column, a packed column, or a combination. A stripping assisting stream 205 (which may include or consist essentially of light/heavy naphtha produced within the IF section unit 300) is recycled to the stripping column 20 with the feed stream (stream 201) and combined into stream 231. This is to promote vapor/liquid traffic at the stripping section of the column 20 to increase $H_2S$ rejection.

The bottom stream 206 then mixes with a slip stream of desalted preheated virgin crude oil 110 from outside the RHCU unit 100 essentially around the same temperature and is then routed as stream 207 to the integrated fractionation section unit 300. The integrated fractionation section unit 300 includes a fractionation column heater and atmospheric distillation tower.

The combined feed 207 is then heated through the heater of the section unit 300 and routed as to a flash zone of an atmospheric distillation column of the IF section unit 300. The atmospheric distillation column may be a trayed column with multiple side cuts. The overhead vapor stream is partially condensed into a reflux stream and an unstablized whole naphtha stream 303. Part of this naphtha stream 303 is recycled back to the stripping column 20 as stream 205 and the remaining amount stream is routed for further processing (not shown in the figure). Multiple side cuts such as stream 305 and 306 are essentially distillate streams and are routed to downstream processing units for further treatment. A column of the integrated fractionation section 300 is a steam stripping column. Heat transfer, mass transfer, and fluid conveying items of equipment generally understood in the art are not depicted in FIG. 2.

The atmospheric column bottom stream 307 is routed to the vacuum column section 400 (of the IF section) and heated in a heater and flashed as stream in the flash zone of the vacuum distillation column of the section 400. The vacuum distillation column may be a packed tray column with trays essentially in the bottom half of the column lower than the feed flash zone. The vacuum is generated using a steam ejector system and the column operates as a "wet vacuum column." Vacuum distillate streams 402 and 403 are then further processed in downstream process units. The vacuum column bottom (boiling greater than 565° C. TBP) stream 404 may be a mixture of unconverted oil from the RHCU and virgin vacuum residue from the virgin crude oil processed in the integrated fractionation section.

A slip stream 406 is routed to an SDU section 500 and the remaining oil 405 is recycled back to the RHCU unit 100. The SDU section 500 includes liquid-liquid extraction using a combination of C3 and C4, or a combination of C4 and C5 (and more preferably C4/C5) solvent stream 600 and three cuts are separated. After solvent recovery, the light (relatively asphaltene free) DAO cut 501 is withdrawn and mixes with stream 405 to form the combined recycle stream 120. In some aspects, relatively asphaltene free DAO cut 501 contains less than 5% asphaltene.

The heavy cut (after solvent recovery) containing asphaltene is routed as a fuel component or to bitumen manufacture as stream 502. The middle cut resin oil (again after solvent recovery) containing heavier aromatics as stream 503 is routed back as fluxing oil to the RHCU unit 100 separator/flash vessels. A slip stream of the resin oil can also routed directly into the RHCU unit 100 reactors as a feed component. The SDU solvent is mostly recovered; a small amount of topping is required to account for losses.

Figure 3:
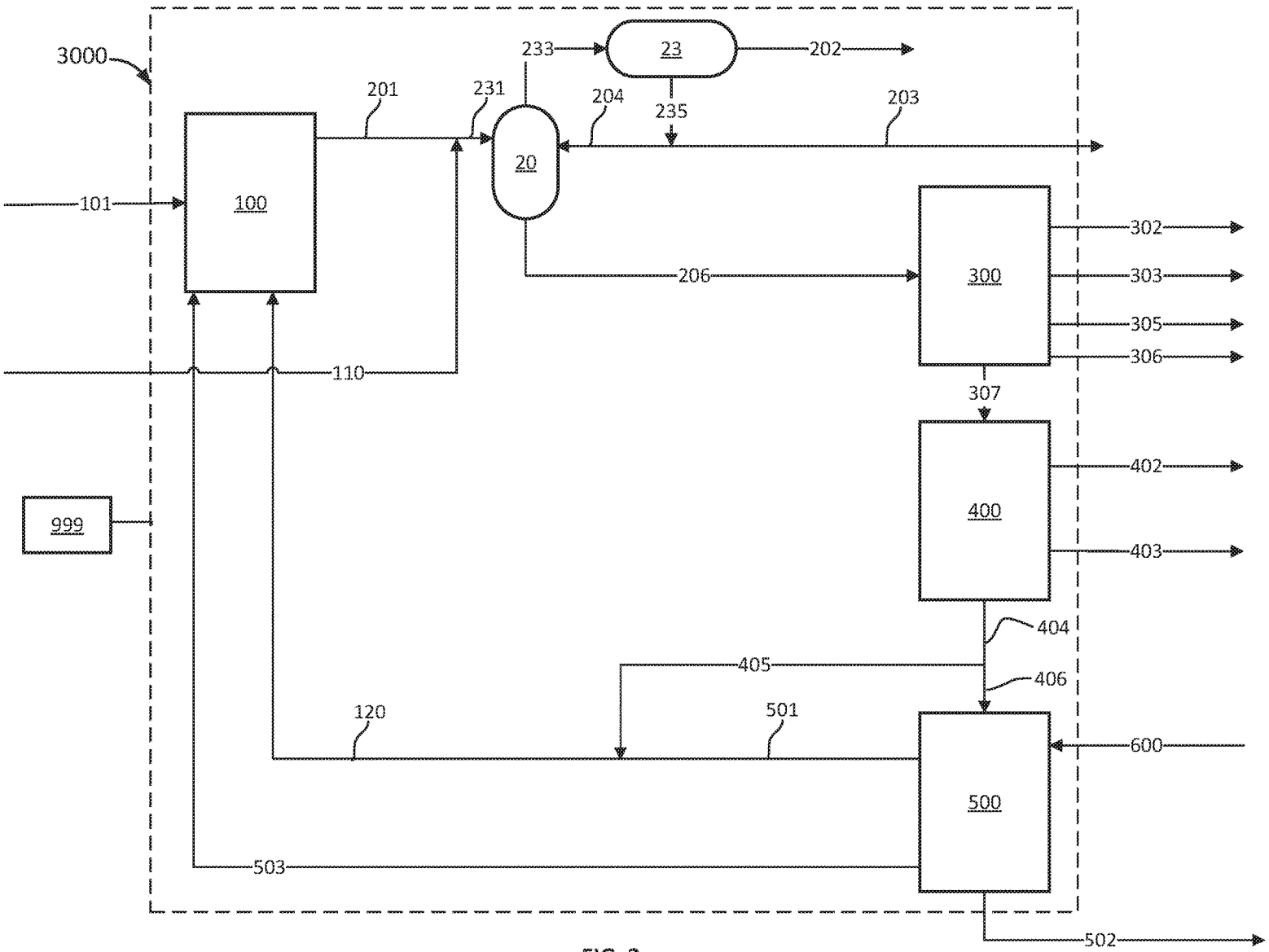
FIG. 3 depicts another example implementation of a residue hydrocracking unit, integrated fractionation, and solvent deasphalting unit system and flow scheme.

In another embodiment, a system 3000 is depicted in FIG. 3. The desalted and preheated crude 110 is mixed with the combined RHCU effluent 201 and sent to the stripping column 20 as stream 231. This addition of crude prior to the stripping column allows for "sponge action" of the crude on the lighter ends generated from the RHCU unit 100, thus decreasing the loss of lighter hydrocarbons with the off gas streams. All other process flow scheme downstream and upstream of this point essentially remain the same as depicted in FIGS. 1 and 2. No additional naphtha stripping (stream 205) assistance is required for stripping column 20.

Figure 4:
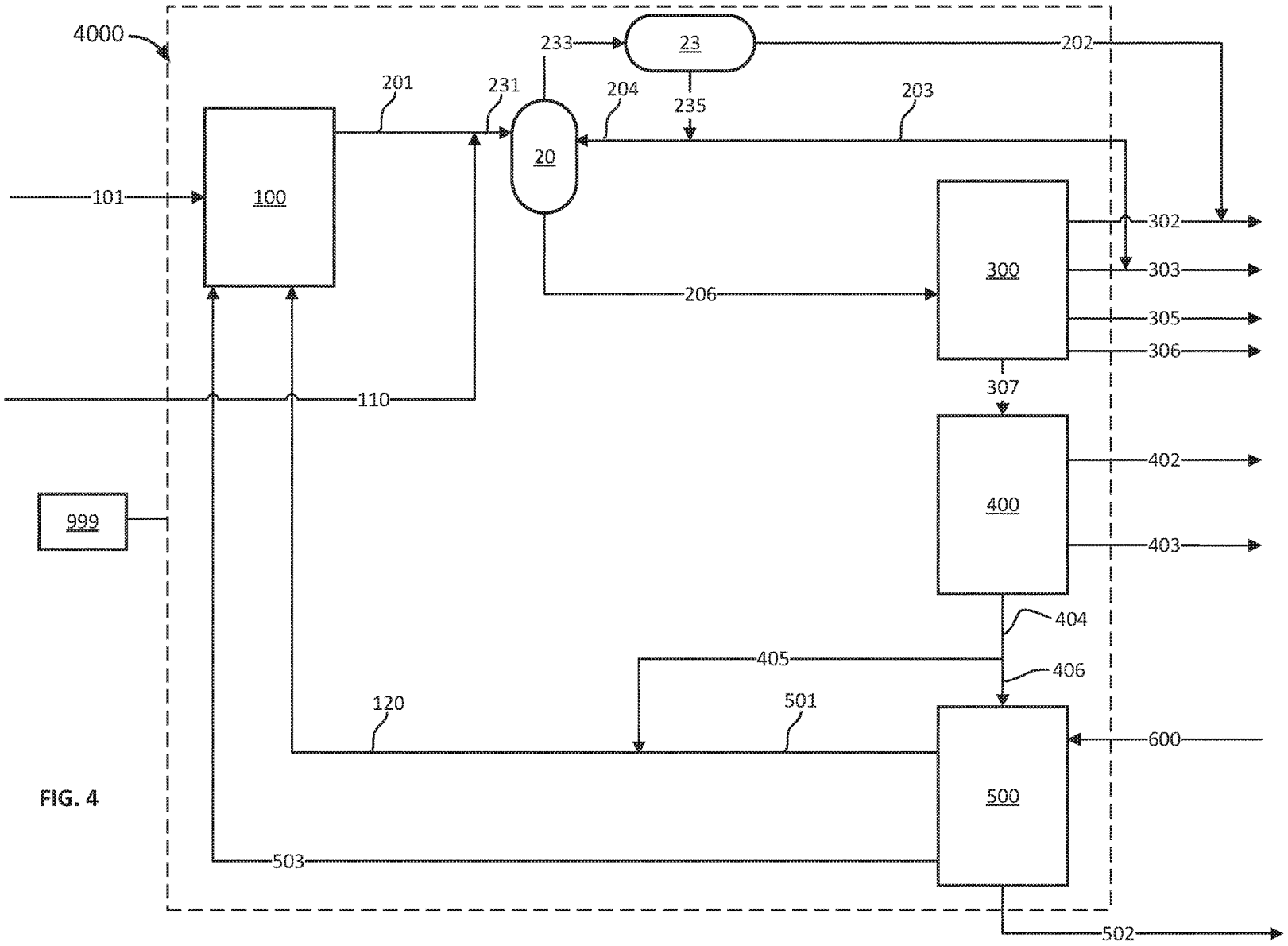
FIG. 4 depicts another example implementation of a residue hydrocracking unit, integrated fractionation, and solvent deasphalting unit system and flow scheme.

In yet another embodiment, a system 4000 is depicted in FIG. 4. The stripping column 20 is replaced by a pre-flash column essentially operating at the atmospheric column pressure. The partially condensed overhead streams are then combined with the partially condensed virgin crude overhead stream. All other process flow scheme downstream and upstream of this point essentially remain the same as depicted in FIGS. 1 and 2. The naphtha recycle stream 205 to stripping column 20 is optional.

The operating conditions for the RHCU reaction zone 100 includes a reaction temperature in the range of 300° C. to 420° C., and a reaction pressure in the range of 125 bars (gauge) (barg) to 250 barg. The operating conditions for the stripping column includes a temperature of the flash zone in the range of 200° C. to 275° C., and a pressure in the range of 1 barg to 14 barg.

The operating conditions for the atmospheric column includes a temperature of the flash zone in the range of 350° C. to 375° C., and a pressure in the range of 1.5 barg to 5 barg.

The operating conditions for the vacuum column includes a temperature of the flash zone in the range of 390° C. to 420° C., and a pressure in the range of 90 mm Hg to 25 mm Hg.

The conversion of the vacuum residue fresh feed in the RHCU is typically in the range of 85 wt % to 90 wt % conversion to 565° C. with a per pass conversion in the range of 40-75 wt % to 565° C.

The SDU section is a three-cut design having a DAO lift in a range of 40% to 60% and a resin cut of 20% to 40% of the feed to the SDU. The SDU solvent includes C3, C4, C5 or a mixture of C3 and C4 or C4 and C5.

The addition of desalted virgin crude oil to the RHCU SYNC contributes to an increase in aromaticity of the material going to the fractionation section, thus allowing stable fractionation operation and hence higher conversion. The addition of resin oil as a flux oil in the reactor effluent promotes stable operations at higher conversion by providing aromatic polarity, resulting in greater solvent power and aromaticity in the effluent. The resin oil is a superior flux than the lower aromatic stock DAO, and thus is preferentially used as a feed and not an intermediate flux oil.

In some embodiments, virgin crude functions as a sponge and diluent in the stripping column thus reducing fouling/ precipitation in the stripping column and prestablizing the virgin crude whole naphtha fraction from the main atmospheric column overhead avoiding a naphtha stablizer after the atmospheric distillation column.

In some embodiments, the virgin crude functions as diluent in the atmospheric fractionation and vacuum columns, thus reducing fouling/precipitation in the fractionation column section and associated equipment.

Since the vacuum distillation column bottom is a mix of RHCU unconverted oil and virgin vacuum residue, the overall quality requires only a slip stream, thereby reducing the SDU size.

In some embodiments, a three cut SDU is used to provide a resin to be used as a flux oil in the RHCU. The resin oil may be used as an aromatic polar flux oil for the reactor effluent at the separator/flash drums of the RHCU.

In some embodiments, naphtha may be recycled as an additional stripping media to remove $H_2S$ in a relatively low light end make system.

In some embodiments, improved thermal efficiency is achieved when virgin crude is coprocessed as it provides a heat sink for common fractionation section rundown and pump around streams heat that cannot be sinked in hot SYNC.

As shown, each of systems 1000, 2000, 3000, and 4000 include a control system 999 that is communicably coupled (wired or wirelessly) to one or more components of the respective systems. Systems 1000, 2000, 3000, or 4000 may be controlled (for example, control of temperature, pressure, flowrates of fluid, or a combination of such parameters) to provide for a desired output given particular inputs. In some aspects, a flow control system for system 1000 can be operated manually. For example, an operator can set a flow rate for a pump or transfer device and set valve open or close positions to regulate the flow of the process streams through the pipes in the flow control system. Once the operator has set the flow rates and the valve open or close positions for all flow control systems distributed across the system, the flow control system can flow the streams under constant flow conditions, for example, constant volumetric rate or other flow conditions. To change the flow conditions, the operator can manually operate the flow control system, for example, by changing the pump flow rate or the valve open or close position.

In some aspects, a flow control system for systems 1000, 2000, 3000, and 4000 can be operated automatically. For example, control system 999 is communicably coupled to the components and sub-systems of systems 1000, 2000, 3000, and 4000. The control system 999 can include or be connected to a computer or control system to operate systems 1000, 2000, 3000, and 4000. The control system 999 can include a computer-readable medium storing instructions (such as flow control instructions and other instructions) executable by one or more processors to perform operations (such as flow control operations). An operator can set the flow rates and the valve open or close positions for all flow control systems distributed across the facility using the control system 999. In such embodiments, the operator can manually change the flow conditions by providing inputs through the control system 999. Also, in such embodiments, the control system 999 can automatically (that is, without manual intervention) control one or more of the flow control systems, for example, using feedback systems connected to the control system 999. For example, a sensor (such as a pressure sensor, temperature sensor or other sensor) can be connected to a pipe through which a process stream flows. The sensor can monitor and provide a flow condition (such as a pressure, temperature, or other flow condition) of the process stream to the control system 999. In response to the flow condition exceeding a threshold (such as a threshold pressure value, a threshold temperature value, or other threshold value), the control system 999 can automatically perform operations. For example, if the pressure or temperature in the pipe exceeds the threshold pressure value or the threshold temperature value, respectively, the control system 999 can provide a signal to the pump to decrease a flow rate, a signal to open a valve to relieve the pressure, a signal to shut down process stream flow, or other signals.

Control system 999 can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a sub combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims Further modifications and alternative implementations of various aspects will be apparent to those skilled in the art in view of this description. Accordingly, this description is to be construed as illustrative only. It is to be understood that the forms shown and described are to be taken as examples of implementations. Elements and materials may be substituted for those illustrated and described, parts and processes may be reversed, and certain features may be utilized independently, all as would be apparent to one skilled in the art after having the benefit of this description. Accordingly, the description of example implementations does not define or constrain this disclosure. Other changes, substitutions, and alterations are also possible without departing from the spirit and scope of this disclosure.

What is claimed is:

1. A system for co-processing crude oil with residuum, the system comprising:

an ebullated bed hydrocracking unit;

an atmospheric distillation column fluidly coupled to the ebullated bed hydrocracking unit;

a vacuum distillation column fluidly coupled to the atmospheric distillation column and the ebullated bed hydrocracking unit;

a deasphalting unit fluidly coupled to the vacuum distillation column and the ebullated bed hydrocracking unit; and a control system communicably coupled to the ebullated bed hydrocracking unit, the atmospheric distillation column, the vacuum distillation column, and the deasphalting unit and configured to perform operations comprising:

operating the deasphalting unit to produce a first cut that comprises deasphalting oil, a second cut that comprises resin oil, and a third cut that comprises asphaltene;

circulating the first cut within a combined recycle stream to the ebullated bed hydrocracking unit;

circulating the second cut to the ebullated bed hydrocracking unit; and circulating the third cut to a fuel or bitumen component manufacture.

2. The system of claim 1, further comprising a stripping column fluidly coupled between the ebullated bed hydrocracking unit and the atmospheric distillation column.

3. The system of claim 2, wherein the control system is configured to perform operations comprising:

circulating effluent from the ebullated bed hydrocracking unit to the stripping column to yield a stripping column bottom stream;

circulating the stripping column bottom stream and a desalted virgin crude to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream; and circulating the combined recycle stream to the ebullated bed hydrocracking unit.

4. The system of claim 2, further comprising a condenser fluidly coupled to the stripping column.

5. The system of claim 4, wherein the control system is configured to perform operations comprising:

circulating a desalted virgin crude and effluent from the ebullated bed hydrocracking unit to the stripping column to yield a stripping column bottom stream;

circulating the stripping column bottom stream to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream; and circulating the combined recycle stream to the ebullated bed hydrocracking unit.

6. The system of claim 1, further comprising a pre-flash column operating at atmospheric column pressure fluidly coupled between the ebullated bed hydrocracking unit and the atmospheric distillation column.

7. The system of claim 6, wherein the control system is configured to perform operations comprising:

circulating a desalted virgin crude and effluent from the ebullated bed hydrocracking unit to the pre-flash column to yield a pre-flash column bottom stream;

combining a partially condensed overhead stream from the pre-flash column with a partially condensed overhead stream from the atmospheric distillation column;

circulating the pre-flash column bottom stream to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream;

circulating the combined recycle stream to the ebullated bed hydrocracking unit.

8. The system of claim 1, wherein the control system is configured to perform operations comprising:

circulating effluent from the ebullated bed hydrocracking unit and a desalted virgin crude to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream;

circulating the combined recycle stream to the ebullated bed hydrocracking unit.

9. The system of claim 1, wherein at least 85 wt % of a vacuum residue fresh feed to the ebullated bed hydrocracking unit is converted into a lighter white oil fraction.

10. The system of claim 9, wherein the control system is configured to perform operations comprising:

heating a desalted virgin crude before providing the desalted virgin crude to the atmospheric distillation column; and circulating the desalted virgin crude to the atmospheric distillation column in a range of 1% to at least 80% of a volumetric feed rate of a vacuum residue fresh feed rate.

11. The system of claim 3, wherein the first portion of the vacuum distillation column bottom stream comprises 40 vol % to 60 vol % of the vacuum distillation column bottom stream.

12. The system of claim 3, wherein the first cut further comprises 40 wt % to 60 wt % of the first portion of the vacuum distillation column bottom stream, and the second cut further comprises 20 wt % to 40 wt % of the first portion of the vacuum distillation column bottom stream.

13. The system of claim 1, wherein the control system is configured to perform operations comprising circulating the second cut to the ebullated bed hydrocracking unit as a flux oil for effluent from the ebullated bed hydrocracking unit.

14. The system of claim 10, wherein the desalted virgin crude comprises a diluent in the atmospheric distillation column.

15. The system of claim 2, wherein the control system is configured to perform operations comprising recycling a naphtha stream as a stripping media to the stripping column to remove hydrogen sulfide.

16. A method for co-processing crude oil with residuum, the method comprising:

fluidly coupling an ebullated bed hydrocracking unit with an atmospheric distillation column;

fluidly coupling a vacuum distillation column to the atmospheric distillation column and the ebullated bed hydrocracking unit;

fluidly coupling a deasphalting unit to the vacuum distillation column and the ebullated bed hydrocracking unit;

operating the deasphalting unit to produce a first cut that comprises deasphalting oil, a second cut that comprises resin oil, and a third cut that comprises asphaltene;

circulating the first cut within a combined recycle stream to the ebullated bed hydrocracking unit;

circulating the second cut to the ebullated bed hydrocracking unit; and circulating the third cut to a fuel or bitumen component manufacture.

17. The method of claim 16, further comprising fluidly coupling a stripping column between the ebullated bed hydrocracking unit and the atmospheric distillation column.

18. The method of claim 17, further comprising:

circulating effluent from the ebullated bed hydrocracking unit to the stripping column to yield a stripping column bottom stream;

circulating the stripping column bottom stream and a desalted virgin crude to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut; and combining the first cut and a second portion of the vacuum distillation column bottom stream to yield the combined recycle stream, and circulating the combined recycle stream to the ebullated bed hydrocracking unit.

19. The method of claim 16, further comprising fluidly coupling a condenser to the stripping column.

20. The method of claim 19, further comprising:

circulating a desalted virgin crude and effluent from the ebullated bed hydrocracking unit to the stripping column to yield a stripping column bottom stream;

circulating the stripping column bottom stream to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream, and circulating the combined recycle stream to the ebullated bed hydrocracking unit.

21. The method of claim 16, further comprising fluidly coupling a pre-flash operating at atmospheric column pressure between the ebullated bed hydrocracking unit and the atmospheric distillation column.

22. The method of claim 21, further comprising:

circulating a desalted virgin crude and effluent from the ebullated bed hydrocracking unit to the pre-flash column to yield a pre-flash column bottom stream;

combining a partially condensed overhead stream from the pre-flash column with a partially condensed overhead stream from the atmospheric distillation column;

circulating the pre-flash column bottom stream to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream, and circulating the combined recycle stream to the ebullated bed hydrocracking unit.

23. The method of claim 16, further comprising:

circulating effluent from the ebullated bed hydrocracking unit and a desalted virgin crude to the atmospheric distillation column to yield an atmospheric distillation column bottom stream;

circulating the atmospheric distillation column bottom stream to the vacuum distillation column to yield a vacuum distillation column bottom stream;

circulating a first portion of the vacuum distillation column bottom stream to the deasphalting unit to yield the first cut, the second cut, and the third cut;

combining the first cut and a second portion of the vacuum distillation column bottom stream to yield the combined recycle stream, and circulating the combined recycle stream to the ebullated bed hydrocracking unit.

24. The method of claim 16, wherein at least 85 wt % of a vacuum residue fresh feed is converted into a lighter white oil fraction in the ebullated bed hydrocracking unit.

25. The method of claim 24, further comprising:

heating a desalted virgin crude before circulating the desalted virgin crude to the atmospheric distillation column; and circulating the desalted virgin crude to the atmospheric distillation column in a range of 1% to at least 80% of a volumetric feed rate of a vacuum residue fresh feed rate.

26. The method of claim 18, wherein the first portion of the vacuum distillation column bottom stream comprises 40 vol % to 60 vol % of the vacuum distillation column bottom stream.

27. The method of claim 18, wherein the first cut further comprises 40 wt % to 60 wt % of the first portion of the vacuum distillation column bottom stream, and the second cut further comprises 20 wt % to 40 wt % of the first portion of the vacuum distillation column bottom stream.

28. The method of claim 16, further comprising circulating the second cut to the ebullated bed hydrocracking unit as a flux oil for effluent from the ebullated bed hydrocracking unit.

29. The method of claim 25, wherein the desalted virgin crude comprises a diluent in the atmospheric distillation column.

30. The method of claim 17, further comprising recycling a naphtha stream as a stripping media to the stripping column to remove hydrogen sulfide.

* * * * *